US011221199B2

(12) United States Patent
Ruegsegger et al.

(10) Patent No.: US 11,221,199 B2
(45) Date of Patent: Jan. 11, 2022

(54) HIGH VELOCITY, RIMFIRE CARTRIDGE

(71) Applicant: Vista Outdoor Operations LLC, Anoka, MN (US)

(72) Inventors: Justin Ruegsegger, Lewiston, ID (US); Robert Winker, Lewiston, ID (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/841,261

(22) Filed: Apr. 6, 2020

(65) Prior Publication Data

US 2020/0363177 A1 Nov. 19, 2020

Related U.S. Application Data

(60) Provisional application No. 62/830,333, filed on Apr. 5, 2019.

(51) Int. Cl.

| | |
|---|---|
| ***F42B 12/74*** | (2006.01) |
| ***F42B 5/32*** | (2006.01) |
| ***F42B 5/02*** | (2006.01) |

(52) U.S. Cl.

CPC ..... *F42B 12/74* (2013.01); *F42B 5/025* (2013.01); *F42B 5/32* (2013.01)

(58) Field of Classification Search

CPC ..... F42B 12/74; F42B 5/025; F42B 5/32
See application file for complete search history.

(56) References Cited

U.S. PATENT DOCUMENTS 1,461,013 A * 7/1923 Hodge ..... F42B 5/32 102/471
1,879,278 A * 9/1932 Jacobs ..... F42B 5/02 102/430

(Continued)

FOREIGN PATENT DOCUMENTS

GB 2440550 A * 2/2008 ..... F42B 12/78

OTHER PUBLICATIONS

22plinkster, CCI Copper 22 Review, Sep. 1, 2016, YouTube video, youtube.com/watch?v=JyuVExAXaw.*

(Continued)

*Primary Examiner* — Benjamin P Lee
(74) *Attorney, Agent, or Firm* — Reed Smith LLP; Matthew P. Frederick; John M. Cogill

(57) ABSTRACT

A .22 caliber rimfire cartridge includes a generally cylindrical casing having a rearward rimfire end and an opposing mouth end, wherein the rearward rimfire end has an annular rim connecting to a cylindrical casing portion extending to a casing forward edge and a bullet is disposed in the forward mouth end. In embodiments, the bullet comprises copper and a polymer binder. In embodiments, the bullet has a forward tapering portion with a central cavity, a first cylindrical portion with a first diameter and a cylindrical surface directly rearward of the tapering portion, a cylindrical driving band directly rearward of the first cylindrical portion, the cylindrical driving band having a second diameter greater than the first diameter and having an outer second cylindrical surface, a third cylindrical portion directly rearward of the cylindrical driving band, the third cylindrical portion having a third cylindrical surface with a diameter equal to the first diameter. In embodiments, the bullet is positioned with the third cylindrical surface mostly or entirely within the casing. In embodiments, the casing has a circumferential crimp positioned at the third circumferential portion. In (Continued)

embodiments, the third circumferential surface having a circumferential indentation at the circumferential crimp.

20 Claims, 13 Drawing Sheets

(56) References Cited

U.S. PATENT DOCUMENTS 1,944,884 A * 1/1934 Ernst ..... F42B 12/34 102/514
2,105,528 A * 1/1938 Foisy ..... F42B 8/02 102/529
2,120,913 A * 6/1938 Studler ..... F42B 14/064 102/516
2,868,130 A * 1/1959 Gulley ..... F42B 5/025 102/501
3,916,795 A * 11/1975 Lemstra ..... F42B 8/16 102/529
4,108,074 A * 8/1978 Billing, Jr. ..... F42B 8/14 102/529
4,674,409 A * 6/1987 Lopata ..... C06B 43/00 102/283
4,689,185 A * 8/1987 Lopata ..... F42B 5/32 102/205
4,811,666 A * 3/1989 Lutfy ..... F42B 12/74 102/307
4,850,278 A * 7/1989 Dinkha ..... F42B 8/16 102/501
4,939,996 A * 7/1990 Dinkha ..... F42B 8/16 102/444
4,958,572 A * 9/1990 Martel ..... F42B 12/74 102/506
5,216,199 A 6/1993 Bjerke et al.
5,275,108 A * 1/1994 Chernicky ..... F42B 10/44 102/439
5,490,463 A * 2/1996 Lamberty ..... F42B 5/32 102/439
6,016,754 A * 1/2000 Enlow ..... F42B 12/74 102/516
6,629,485 B2 10/2003 Vaughn et al.
9,255,775 B1 2/2016 Rubin
10,041,770 B2 8/2018 Burrow
2008/0156222 A1* 7/2008 Orlanov ..... F42B 5/025 102/514
2010/0242778 A1* 9/2010 Calero Martinez ..... F42B 12/74 102/517
2014/0196625 A1* 7/2014 Huffman ..... F42B 12/36 102/444
2017/0205215 A1* 7/2017 Sloff ..... F42B 12/74

OTHER PUBLICATIONS

Gil Horman, NRA American Rifleman Article-Tested: CCI Copper-22 Ammunition dated Nov. 10, 2016 website printout https://www.americanrifleman.org/articles/2016/11/10/tested-cci-copper-22-ammunition.*

International Search Report and Written Opinion dated Oct. 7, 2020 for PCT/US20/26895.

* cited by examiner

HIGH VELOCITY, RIMFIRE CARTRIDGE

CROSS-REFERENCE TO RELATED APPLICATIONS

This application claims the benefit of U.S. Provisional Application No. 62/830,333, filed Apr. 5, 2019, the entire contents of which is incorporated by reference herein.

FIELD OF THE INVENTION

The present invention is directed to firearm cartridges for improving safety, reliability, and performance.

BACKGROUND OF THE INVENTION

In order to maintain their proficiency with various types of firearms, military personnel, law enforcement officers and hunters frequently engage in target practice. In the sport of hunting, marksmanship is practiced so that a shot can be carefully placed to ensure a quick, clean and humane kill. For military personnel, good marksmanship may make the difference between victory and defeat in battlefield situations. Target practice is often performed at a shooting range with several dozens or hundreds of cartridges being fired at each practice session. The expense involved in firing so many rounds can be mitigated by using a firearm that fires 22 caliber long rifle rimfire ammunition. 22 caliber long rifle rimfire ammunition is extremely popular for target shooting, plinking, and small game hunting due to its low cost and generally high performance. A vast array of handguns and rifles accept 22 caliber long rifle rimfire ammunition, including single shot rifles, bolt action rifles, and semi-automatic rifles. Millions of 22 caliber rifles have been manufactured to use this ammunition.

Certain jurisdictions have restrictions in place or planned relating to lead ammunition. Lead-free bullets are known such as copper particle bullets with polymer binders.

SUMMARY OF THE INVENTION

In embodiments, a .22 caliber rimfire cartridge includes a generally cylindrical casing having a rearward rimfire end and an opposing mouth end, wherein the rearward rimfire end has an annular rim connecting to a cylindrical casing portion extending to a casing forward edge and a bullet is disposed in the forward mouth end. In embodiments, the bullet comprises copper and a polymer binder. In embodiments, the bullet has a forward tapering portion with a central cavity, a first cylindrical portion with a first diameter and a cylindrical surface directly rearward of the tapering portion, a cylindrical driving band directly rearward of the first cylindrical portion, the cylindrical driving band having a second diameter greater than the first diameter and having an outer second cylindrical surface, a third cylindrical portion directly rearward of the cylindrical driving band, the third cylindrical portion having a third cylindrical surface with a diameter equal to the first diameter. In embodiments, the bullet is positioned with the third cylindrical surface mostly or entirely within the casing. In embodiments, the casing has a circumferential crimp positioned at the third circumferential portion. In embodiments, the third circumferential surface having a circumferential indentation at the circumferential crimp. In embodiments, rimfire cartridges have a leaded projectile or bullet without a jacket; or a jacketed projectile or bullet. In embodiments, the bullet is composed of lead. In embodiments, the bullet comprises a core and a jacket, wherein the jacket at least partially surround the core. In embodiments, the core composition is selected from zinc, tin, lead, copper powder, and iron powder. In embodiments, the jacket composition is selected from copper, brass plated steel, brass, plated steel, and a polymer.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
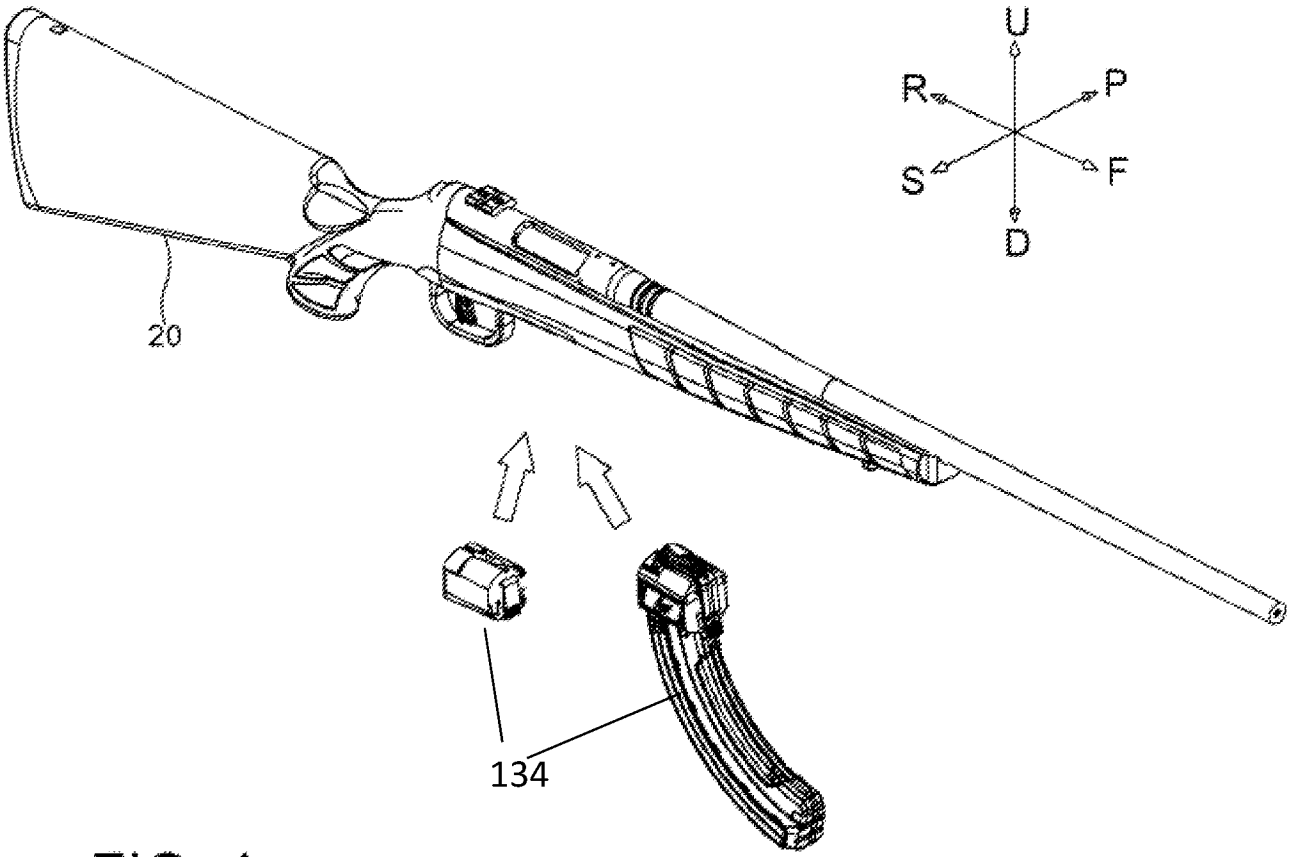
FIG. 1 is a perspective view showing a rimfire rifle and magazines for holding rimfire cartridges.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Nonlead bullets with metal particles are significantly less dense than lead bullets and therefore lighter such that similar sized non-lead bullets are capable of firing at greater velocities utilizing similar propellant loads as cartridges with heavier lead bullets. Such lightweight bullets are more rigid and accordingly do not deform as readily as lead bullets. The inventors have determined that the light weight metal and polymer bullets do not consistently obturate and seal as effectively as lead bullets in firearm barrels, and further that such bullets do not secure in the mouths of casings as well as lead bullets. Moreover, the inventors have discovered that such cartridges with lightweight metal/polymer bullets, particularly copper particles in polymer matrix, particularly 22 caliber cartridges, that are designed to provide bullet kinetic energy comparable to high performance 22 caliber lead bullets, are highly sensitive to common variables involved in conventional cartridge manufacturing. Applicants have observed that such sensitivity results in variable performance of cartridges, the variability much worse than cartridges with lead bullets. Moreover, applicants have discovered that such variability is particularly problematic in firearms that utilize blow back from the cartridges for cycling the firearm, such as popular semi-automatic 22 caliber rifles. The variability in performance results in an unacceptable high scrap rate of manufactured cartridges and/or jamming in semi-automatic 22 caliber firearms.

A feature and advantage of embodiments is a cartridge having a crimped portion that provides increase friction between the casing and the projectile of the cartridge. A feature and advantage of embodiments is a cartridge having a crimped portion that provides higher release pressure of a joint between the casing and the projectile of the cartridge.

A feature and advantage of embodiments is a cartridge 100 in which the casing 102 and the projectile 114 are deformed to create an interlocking feature thereby increasing bullet push and pull forces with or without the addition of a case mouth crimp 126.

A feature and advantage of embodiments is a cartridge 100 having increased bullet push/pull forces that allow use of slower burning propellants to provide minimal risk of partial ignitions resulting in off sounds and high pressure/velocity ranges with lead-free light weight (<32 grains) bullets 114.

A feature and advantage of embodiments is a cartridge 100 containing a slower burning propellant, the cartridge 100 being configured to generate sufficient gas pressure, upon ignition of the propellant, for operation of a blow back reloading mechanism of a rimfire rifle or handgun.

A feature and advantage of embodiments is a cartridge 100 having a crimped portion 126 that provides increase friction between the casing 102 and the projectile 114 of the cartridge 100. In embodiments, a bullet pull force required to separate the projectile 114 from the casing 102 is greater than 70 lbs. In embodiments, a bullet pull force required to separate the projectile 114 from the casing 102 is greater than 72 lbs. In embodiments, a bullet pull force required to separate the projectile 114 from the casing 102 is greater than 75 lbs.

A feature and advantage of embodiments is a cartridge 100 having a crimped portion 126 that provides higher release pressure of a joint between the casing 102 and the projectile 114 of the cartridge 100.

A feature and advantage of embodiments is a cartridge 100 in which the casing 102 and the projectile 114 are deformed to create an interlocking feature thereby increasing bullet push and pull forces with or without the addition of a case mouth crimp 126.

A feature and advantage of one or more embodiments is a projectile 114 that addresses environmental concerns regarding lead by providing a projectile 114 that is free of lead. A feature and advantage of one or more embodiments is a lead-free projectile 114 having a driving band 126.

A feature and advantage of embodiments is a cartridge 100 including a light weight lead-free projectile 114 weighing less than a lead projectile of the same size (e.g., having the same body volume). A feature and advantage of embodiments is a cartridge 100 including lead-free projectile 114 having a weight less than 32 grains. A feature and advantage of embodiments is a cartridge 100 including lead-free projectile 114 having a weight less than 29 grains. A feature and advantage of embodiments is a cartridge 100 including lead-free projectile 114 having a weight less than 26 grains. A feature and advantage of embodiments is a cartridge 100 including lead-free projectile 114 having a weight less than 23 grains.

The inventors associated with the instant application have conceived of a cartridge 100 having casing 102 that holds onto the projectile 114 longer, even when the cartridge 100 is fired from a sporting chambered rifle 20. In embodiments, the cartridge 100 allows a sporting rifle 20 to perform more like a match rifle.

A feature and advantage of embodiments is a cartridge 100 including a retention mechanism that allows the cartridge casing to retain the cartridge projectile a fraction of a second longer than the same cartridge without the retention mechanism. Retaining the cartridge projectile a fraction of a second longer provides accuracy more like that of a match chambered rifle when the cartridge is being used in a sporting chambered rifle. A match chamber is typically used when maximum accuracy is desired. With a rifle having a match chamber, cartridges are typically individually loaded into the rifle (in other words, one-at-a-time). When each cartridge 100 is chambered, the projectile 114 engages the rifling in the barrel. The engagement between the projectile and the rifling causes a match rifle hold onto the projectile longer, upon ignition of the propellant, relative to a rifle with a sporting chamber. In a sporting chambered rifle 20, on the other hand, there may be a jump between the rifling and the chamber so that the projectile does not engage the rifling when a cartridge is chambered in the sporting rifle.

A sporting chamber may be used when a combination of convenience and accuracy is desired. In embodiments, a sporting chambered rifle 20 may be used in conjunction with removable magazines 134 that each hold a plurality of rimfire cartridges. The use of removable magazines 134 allows a plurality of cartridges 100 to be easily loaded into the firearm by inserting a single magazine 134 into the firearm. After each cartridge 100 is fired, a manually or automatically operated mechanism moves the bolt of the firearm backward and then forward again. The upper most cartridge 100 in the magazine 134 is pulled off of a stack of cartridges each time the mechanism cycles so that cartridges are fed one-by-one into the firing chamber of the firearm. Each magazine typically has an elongate housing defining a chamber with a spring-loaded follower slidably disposed therein. The force of the spring-loaded follower urges each cartridge 100 in the magazine 134 toward the upper most position in the where the bolt can push it into the firing chamber. When all of the cartridges 100 have been fired, the empty magazine 134 is removed from the firearm and a new magazine 134 is inserted in its place. The empty magazine 134 may then be refilled with cartridges 100.

A feature and benefit of embodiments is a process for manufacturing lots/batches of cartridges 100, wherein the cartridges 100 of each lot/batch exhibit more consistent ballistic characteristics when fired from sporting chambered rifle 20. In embodiments, the process provides lots/batches of cartridges 100 in which the cartridges 100 of each lot/batch exhibit a mean velocity greater than 1145 fps and a velocity standard deviation less than 145 fps when fired from a sporting chambered rifle 20. In embodiments, the process provides lots/batches of cartridges 100 in which the cartridges 100 of each lot/batch exhibit an average pressure greater than 18,000 psi and a pressure standard deviation less than 1000 psi when fired from a sporting chambered rifle 20.

A feature and benefit of embodiments is a crimping process for manufacturing lots/batches of crimped cartridges 100, wherein the crimped cartridges 100 of each lot/batch exhibit more consistent ballistic characteristics when fired from sporting chambered rifle 20 relative to un-crimped cartridges. In embodiments, the crimping process provides lots/batches of cartridges 100 in which the crimped cartridges having a crimped cartridge velocity standard deviation of a first value when fired from a sporting chambered rifle. For comparison, a lot/batch of un-crimped cartridges have an un-crimped cartridge velocity standard deviation of a second value when fired from a sporting chambered rifle. In embodiments, the ratio of the second value to the first value is greater than 2.0. In embodiments, the ratio of the second value to the first value is greater than 1.5. In embodiments, the ratio of the second value to the first value is greater than 2.5.

A feature and advantage of embodiments is a cartridge projectile having a driving band portion and a bore riding nose portion. In embodiments, the bore riding nose portion has an outer diameter selected to provide a snug fit into a corresponding rifle bore when the cartridge is chambered in the rifle. In certain embodiments, the diameter of the bore riding nose portion is the same as the bore. In other embodiments, the diameter of the bore riding nose portion is slightly less than the diameter of the bore. In still further embodiments, the diameter of the bore riding nose portion is slightly greater than the diameter of the bore. In embodiments, the cartridge is dimensioned and configured so that the bore riding nose portion contacts the rifling inside the rifle barrel when the cartridge is chambered in the match chambered rifle. In embodiments, the bore riding nose portion has an outer diameter selected so that and resistance of the bore riding nose portion engaging the rifling is easily overcome using force provided by the user's hands when the cartridge is chambered in the match chambered rifle having a bolt action and/or a single shot action. In embodiments, the cartridge is dimensioned and configured so that the bore riding nose portion does not contact the rifling inside the rifle barrel when the cartridge is chambered in a sporting chambered rifle. In embodiments, the cartridge is dimensioned and configured so that the driving band portion engages the rifling inside the rifle barrel after the cartridge is chambered in a sporting chambered rifle and the rifle is fired, igniting the cartridge propellant.

Certain embodiments herein are specifically addressed to projectiles from .15 caliber to .38 caliber. In embodiments, the cartridge has a .17 caliber projectile. In embodiments, the cartridge has a .22 caliber projectile.

In embodiments, rimfire cartridges have a lead-free projectile or bullet, a lead projectile or bullet; or a jacketed projectile or bullet.

Figure 8:
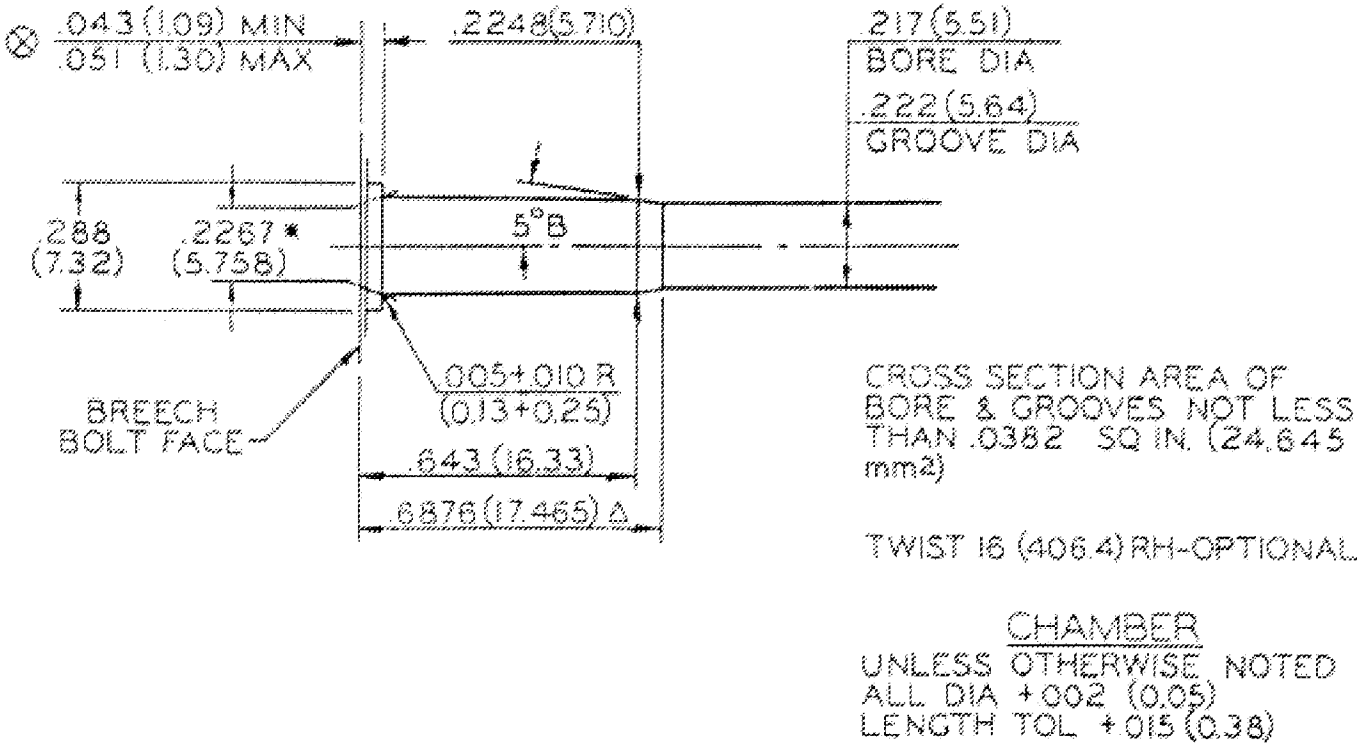
FIG. 8 PRIOR ART
FIG. 8 is a stylized cross-sectional view showing a match chamber for a rifle barrel, according to the prior art.
Figure 9:
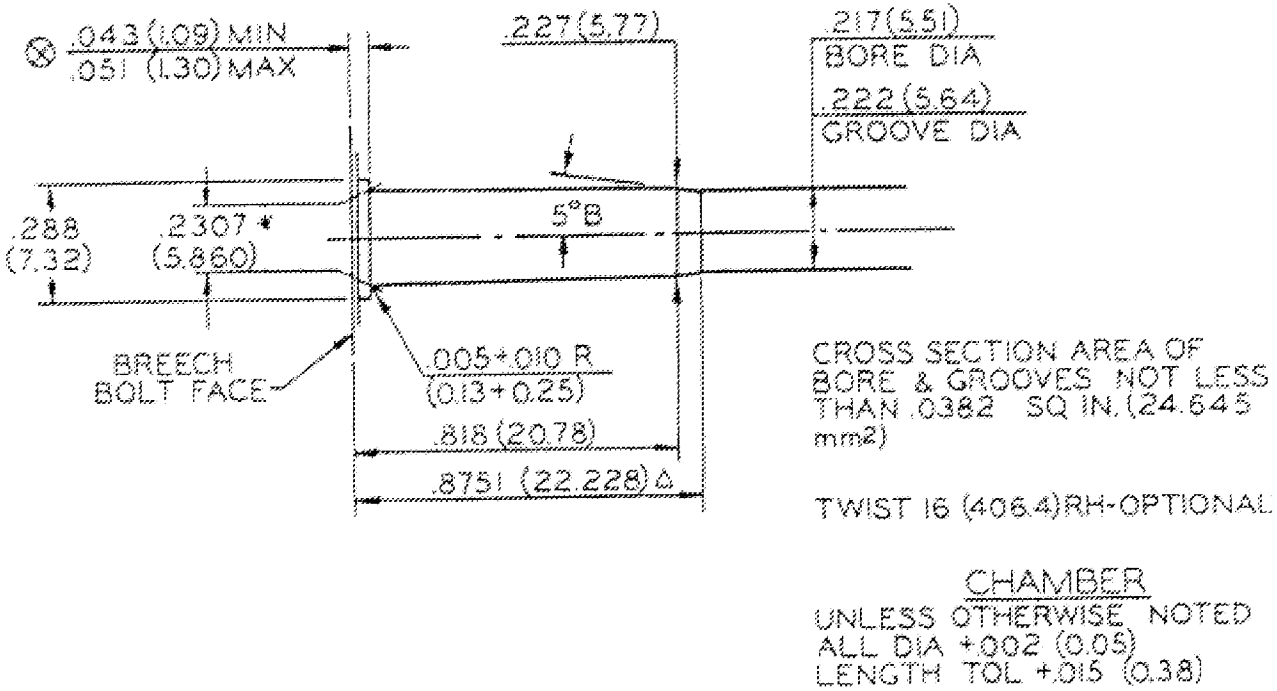
FIG. 9 PRIOR ART
FIG. 9 is a stylized cross-sectional view showing a sporting chamber for a rifle barrel, according to the prior art.

Referring to FIGS. 1, 8 and 9, rimfire rifles may be configured with one of a plurality of different chamber types. A match chamber (such as, for example, a match chamber with the dimensions shown in FIG. 8) may be used when maximum accuracy is desired. A sporting chamber (such as, for example, a sporting chamber with the dimensions shown in FIG. 9) may be used when a combination of convenience and accuracy is desired. Referring to FIG. 1, a sporting rifle 20 may be used in conjunction with removable magazines that each hold a plurality of rimfire cartridges. The use of removable magazines allows a plurality of cartridges to be easily loaded into the firearm by inserting a single magazine into the firearm. After each cartridge is fired, a manually or automatically operated mechanism moves the bolt of the firearm backward and then forward again. The upper most cartridge in the magazine is pulled off of a stack of cartridges each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper most position in the where the bolt can push it into the firing chamber. When all of the cartridges have been fired, the empty magazine is removed from the firearm and a new magazine is inserted in its place. The empty magazine may then be refilled with cartridges.

With a rifle having a match chamber, cartridges may be individually loaded into the rifle (in other words, one-at-a-time). When each cartridge is chambered, the projectile engages the rifling in the barrel. The engagement between the projectile and the rifling causes a match rifle hold onto the projectile longer, upon ignition of the propellant, relative to a rifle with a sporting chamber.

In a sporting rifle, there may be a jump between the rifling and the chamber so that the projectile does not engage the rifling when a cartridge is chambered in the sporting rifle.

The inventors associated with the instant application have conceived of a cartridge having casing that holds onto the projectile longer, even when the cartridge is fired from a sporting rifle. In embodiments, this cartridge allows a sporting rifle to perform more like a match rifle.

Figure 2:
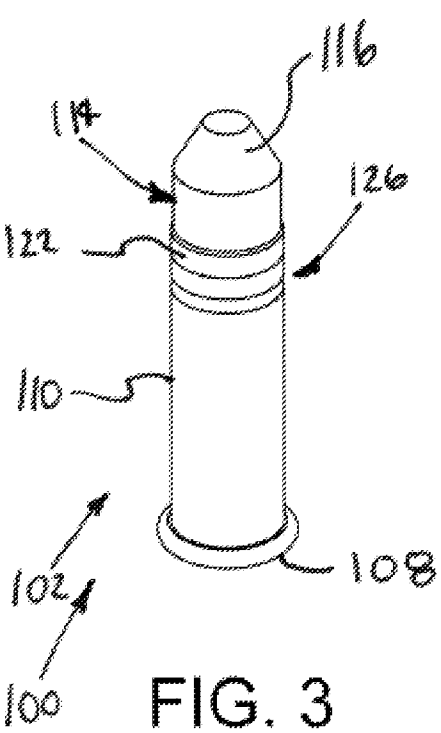
FIG. 2 is a side view of a rimfire cartridge.
Figure 3:
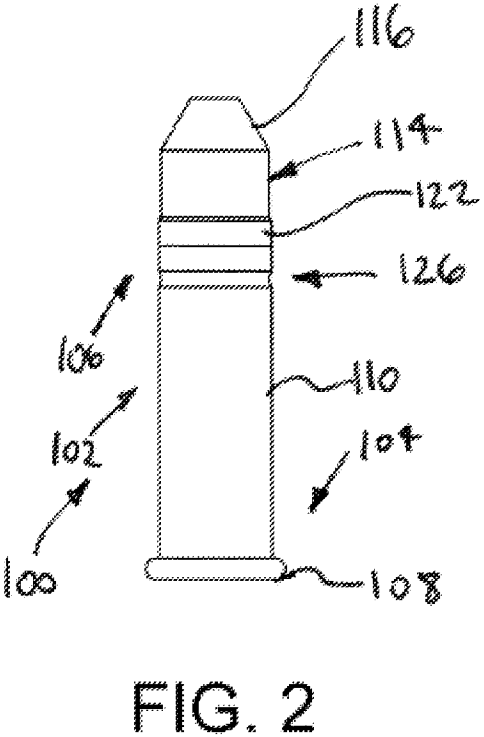
FIG. 3 is a perspective view of a rimfire cartridge.
Figure 10:
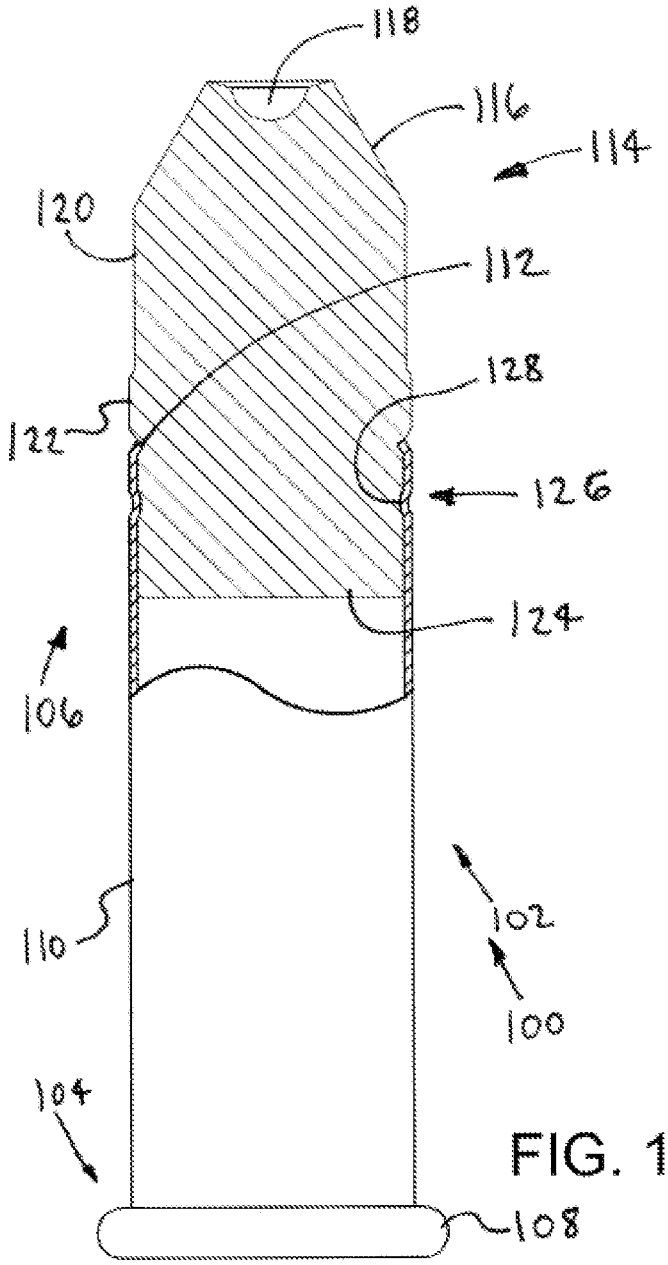
FIG. 10 is a partial cross-sectional view showing a rimfire cartridge including a casing and a projectile or bullet.
Figure 11:
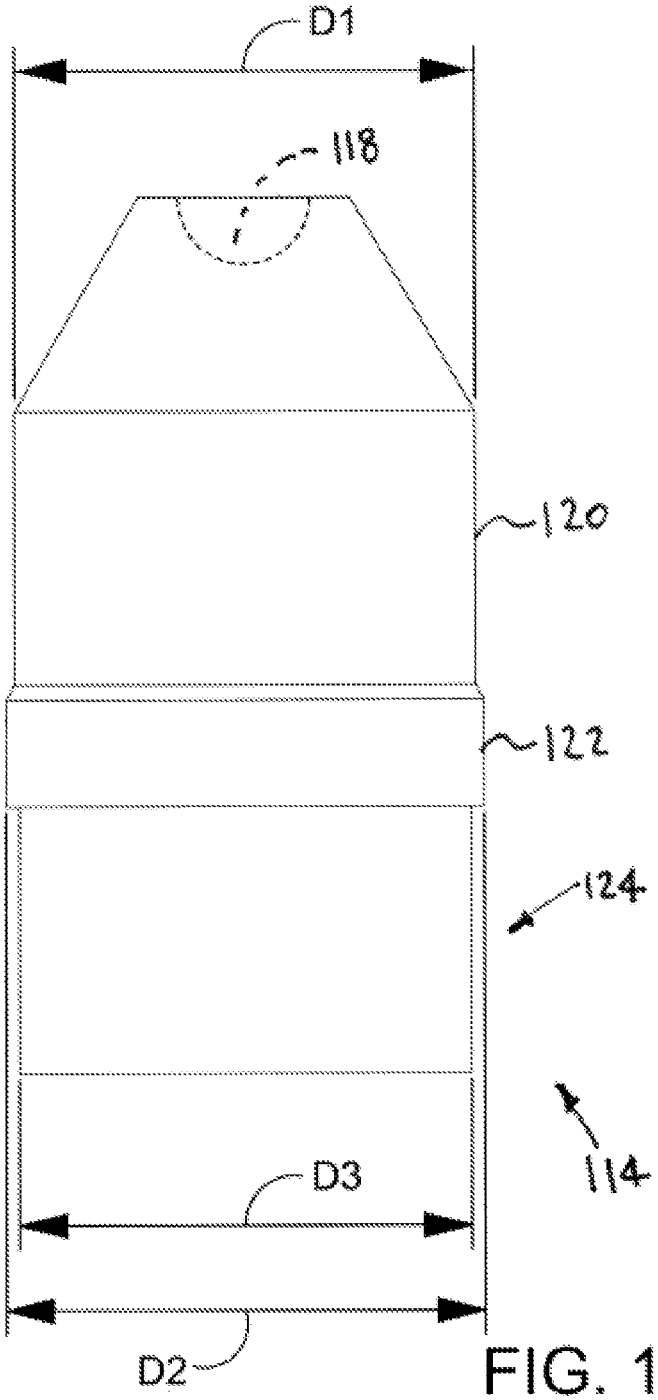
FIG. 11 is a side view showing a projectile or bullet.
Figure 12C:
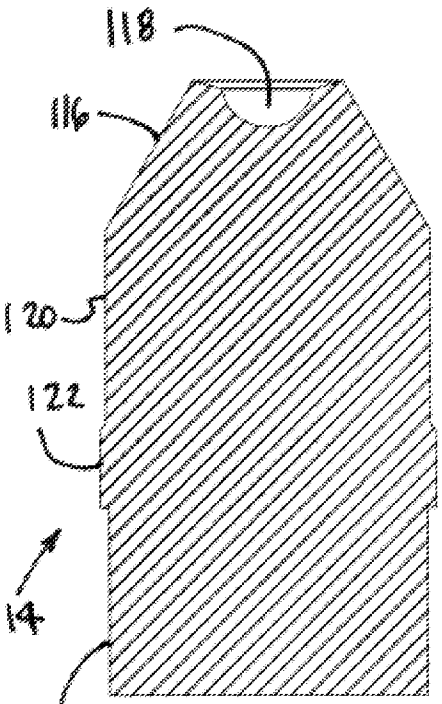
FIG. 12C is a cross-sectional view showing a projectile or bullet.
Figure 12B:
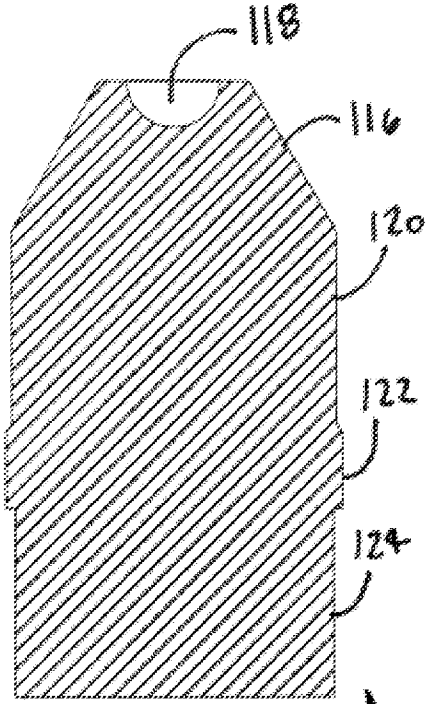
FIG. 12B is a cross-sectional view showing a projectile or bullet.
Figure 12A:
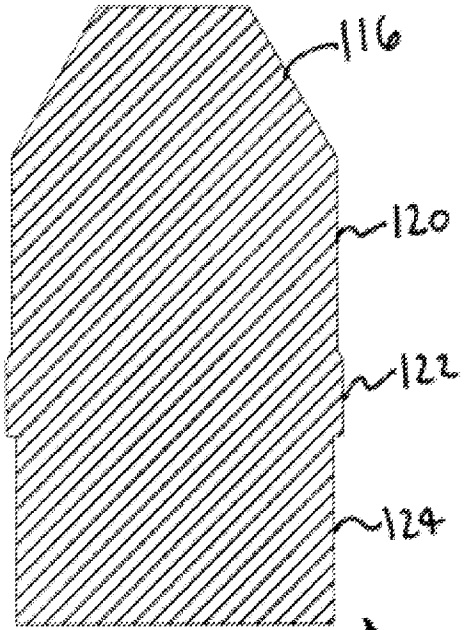
FIG. 12A is a cross-sectional view showing a projectile or bullet.
Figure 13:
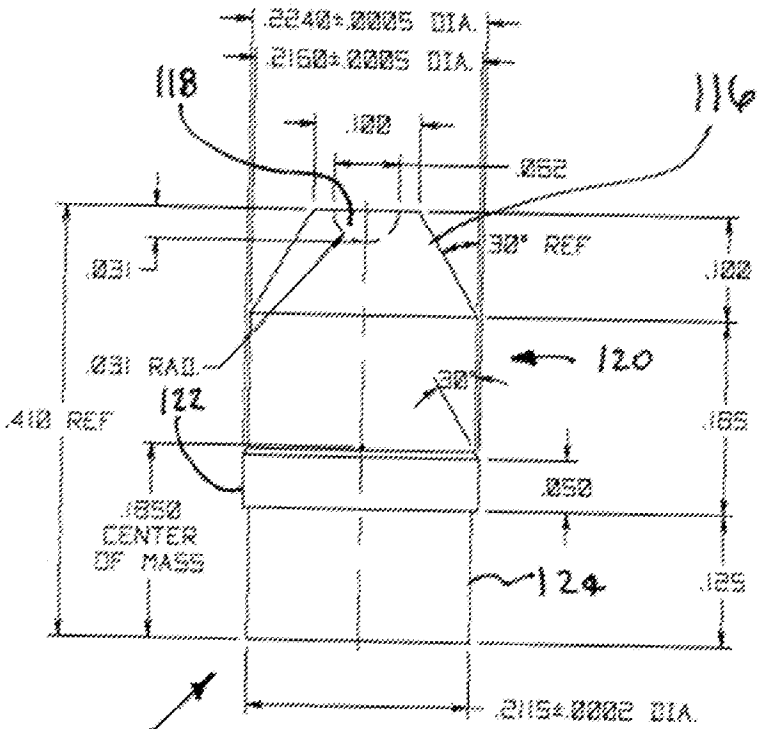
FIG. 13 is a side view showing a projectile or bullet.

Referring to FIGS. 2, 3 and 10, in embodiments, a lead-free .22 caliber rimfire cartridge 100 includes a generally cylindrical casing 102 having a rearward rimfire end 104 and an opposing mouth end 106, wherein the rearward rimfire end 104 has an annular rim 108 connecting to a cylindrical casing portion 110 extending to a casing forward edge 112 and a lead-free bullet 114 is disposed in the forward mouth end 106. In embodiments, the bullet 114 comprises copper and a polymer binder. In embodiments, referring to FIG. 11, the bullet 114 has a forward tapering portion 116 with a central cavity 118, a first cylindrical portion 120 with a first diameter D1 and a cylindrical surface directly rearward of the forward tapering portion 116, a cylindrical driving band 122 directly rearward of the first cylindrical portion 120, the cylindrical driving band 122 having a second diameter D2 greater than the first diameter D1 and having an outer second cylindrical surface, a third cylindrical portion 124 directly rearward of the cylindrical driving band 122, the third cylindrical portion 124 having a third cylindrical surface with a third diameter D3 equal to the first diameter D1. In some embodiments, the first cylindrical portion 120 is a bore riding nose portion. In embodiments, the bullet 114 is positioned with the third cylindrical portion 124 mostly or entirely within the casing 102. In embodiments, the casing 102 has a circumferential crimp 126 positioned at the third cylindrical portion 124. In embodiments, the third circumferential portion 124 has a circumferential indentation 128 at the circumferential crimp 126.

Referring to FIGS. 10-13, in embodiments, a lead-free .22 caliber rimfire cartridge 100 comprises a generally cylindrical casing 102 having a rearward rimfire end 104 and an opposing mouth end 106, wherein the rearward rimfire end 104 has an annular rim 108 connecting to a cylindrical casing portion 110 extending to a casing forward edge 112. A lead-free bullet 114 may be disposed in the forward mouth end 106. In embodiments, the bullet 114 comprising copper and a polymer binder. In embodiments, the bullet weighs 21 grains (plus or minus 2 grains). In embodiments, referring to FIGS. 12A to 12C, the bullet 114 has a forward or first cylindrical portion 120, a driving band 122 rearward of the forward or first cylindrical portion, and a rearward or third cylindrical portion 124 rearward of the driving band 122. In embodiments, the bullet 114 has a center of mass and the driving band positioned rearward of the center of mass. In some embodiments, the diameter of the driving band is greater than the bore diameter. In other embodiments, the diameter of the driving band is less than the diameter of the grooves or rifling in the bore or barrel. In embodiments, the bullet 114 is positioned with rearward or third cylindrical portion 124 mostly within the casing 102. In embodiments, the casing 102 has a circumferential crimp 126 positioned at the rearward or third cylindrical portion 124 and the rearward or third cylindrical portion 124 has a circumferential recess 128 at the circumferential crimp 126. In embodiments, the driving band 122 has a cylindrical surface with a diameter of 0.2240 inches (plus or minus 0.0010 inches), an axial length of 0.050 inches (plus or minus 0.010 inches), and a length of 0.410 inches (plus or minus 0.020 inches). In embodiments, the driving band 122 is position forwardly of the casing mouth end 106. In embodiments, the bullet 114 is positioned with the rearward or third cylindrical portion 124 at least 95% lengthwise within the casing 102.

Figure 6:
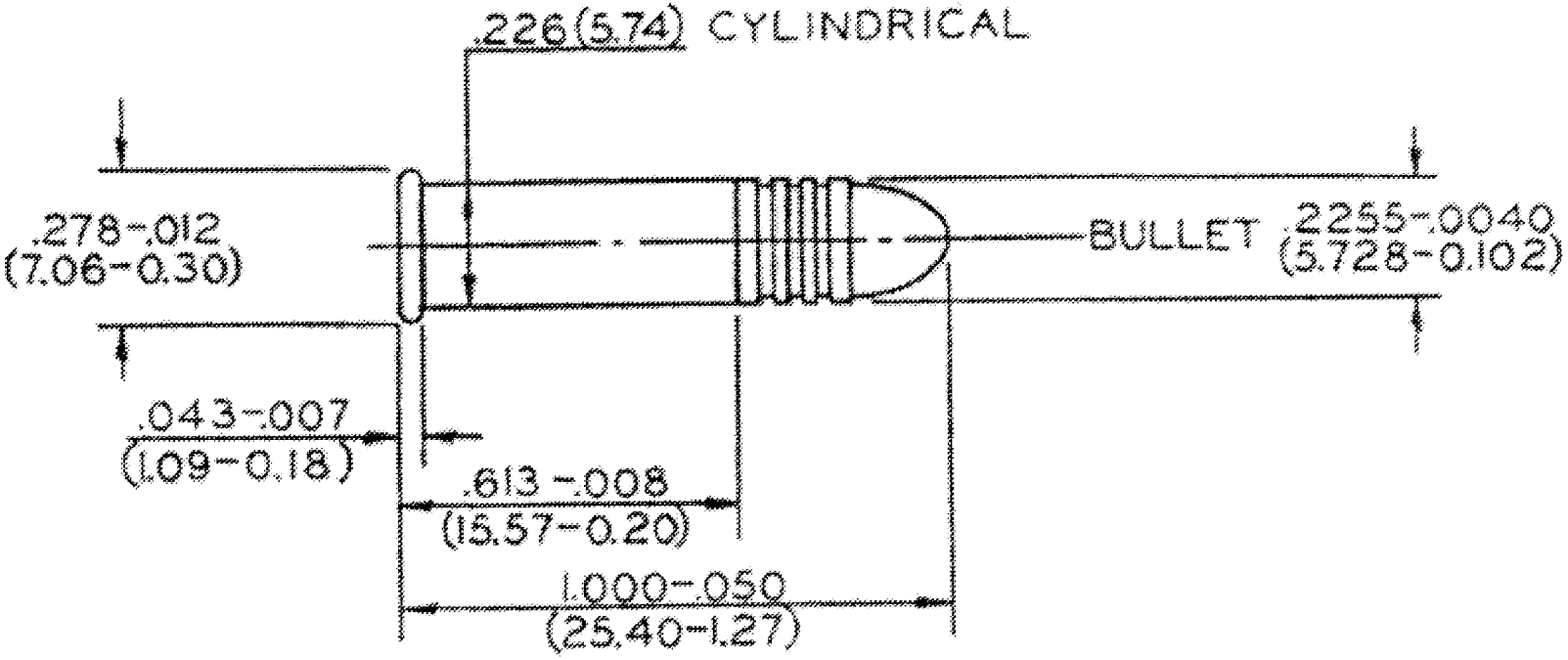
FIG. 6 PRIOR ART
FIG. 6 is a side view of a rimfire cartridge, according to the prior art.
Figure 7:
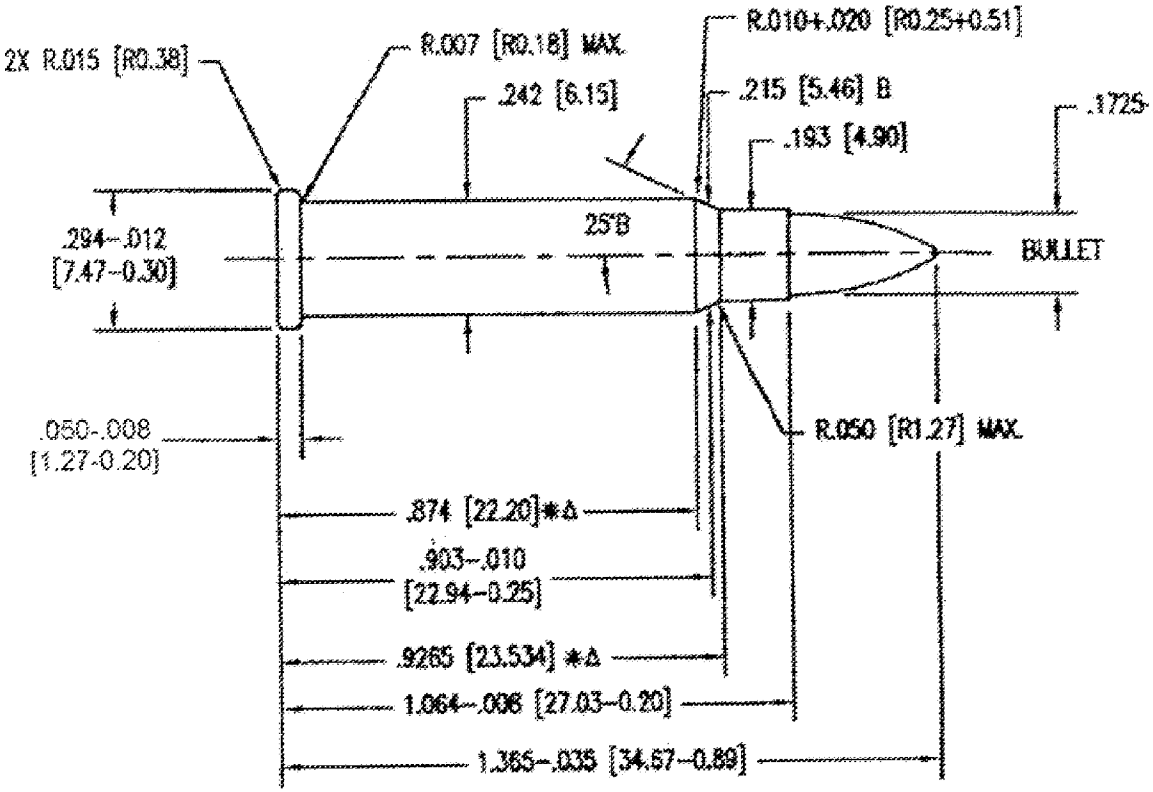
FIG. 7 PRIOR ART
FIG. 7 is a side view of a rimfire cartridge, according to the prior art.

Referring to FIGS. 6 and 7, by way of example, prior art cartridges not having crimps or driving bands are shown. In FIG. 6, a prior art lead cartridge has grooves that are not driving bands, but that help to reduce lead fouling. FIG. 7 shows a prior art 17 HMR cartridge.

Referring to FIG. 1, an upward direction U and a downward direction D are illustrated using arrows labeled "U" and "D." A forward direction F and a rearward direction R are illustrated using arrows labeled "F" and "R," respectively, in FIG. 1. A starboard direction S and a port direction P are illustrated using arrows labeled "S" and "P," respectively, in FIG. 1. In the embodiment of FIG. 1, these directions may be conceptualized from the point of view of a user who is holding the rifle 20. In embodiments, the rifle 20 may be used in conjunction with removable magazines that each hold a plurality of rimfire cartridges. The use of removable magazines may allow a plurality of cartridges to be easily loaded into the firearm by inserting a single magazine into the firearm.

Figure 5:
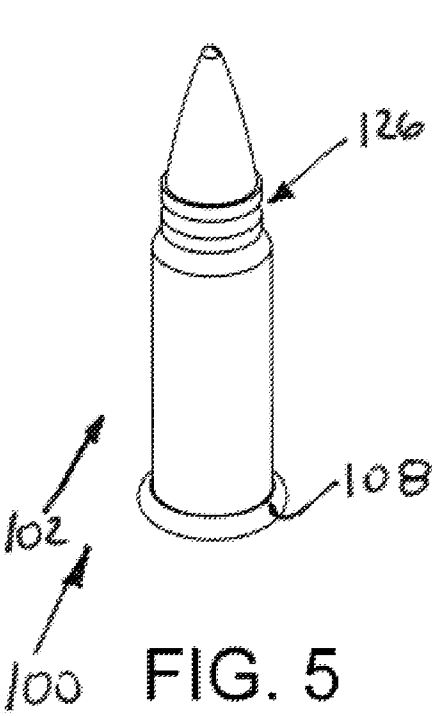
FIG. 5 is a perspective view of a rimfire cartridge.
Figure 4:
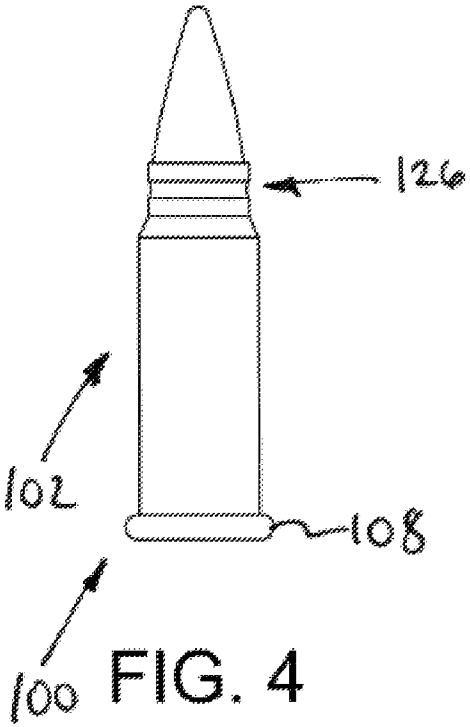
FIG. 4 is a side view of a rimfire cartridge.

Referring to FIGS. 4 and 5, in embodiments a bottleneck rimfire cartridge 100 has casing 102, annular rim 108, crimp 126 and a jacketed projectile or bullet having no driving band. In certain embodiments, such a cartridge may include a .17 caliber, mach 2 cartridge.

In embodiments, rimfire cartridges have a lead projectile or bullet without a jacket; or a jacketed projectile or bullet. For jacket-free lead projectiles or bullets, the projectile or bullet may appear the same as bullet 114 of FIG. 10 and include a driving band 112. Likewise, the cartridge of this embodiment may include a casing 102 and crimp 126 as shown in FIG. 10. In other embodiments, a lead bullet may not have a driving band, but may still include a casing 102 and crimp 126 as shown in FIG. 10.

Figure 14:
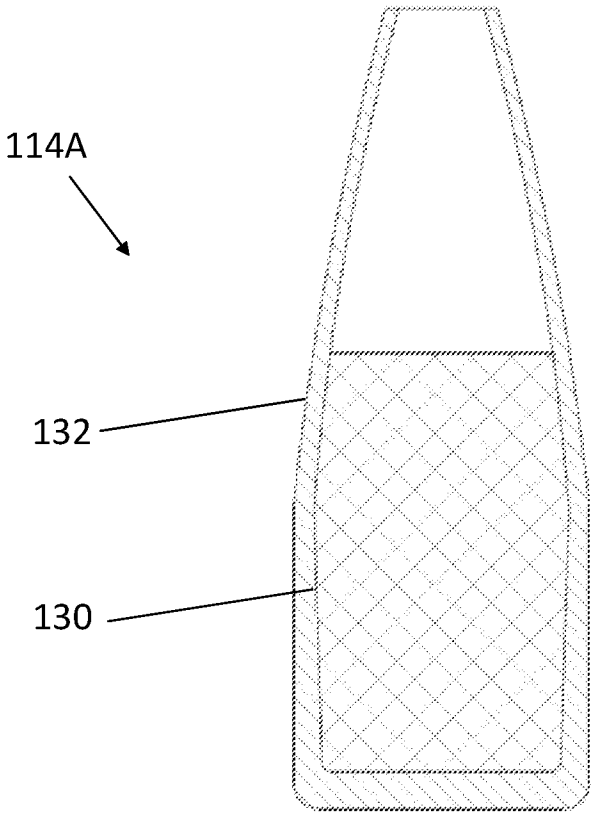
FIG. 14 is a cross-sectional view showing a projectile or bullet according to another embodiment.

Referring to FIG. 14, in embodiments, rimfire cartridges. may have a projectile or bullet 114A with a core 130 and a jacket 132 wherein jacket 132 at least partially surrounds core 130. The cartridge of this embodiment includes a casing 102 and crimp 126 as shown in FIG. 10. In embodiments having jacketed projectiles or bullets, the core of the projectiles or bullets may be selected from zinc, tin, lead, copper powder, or iron powder. In embodiments having jacketed projectiles or bullets, the jacket may be selected from copper, brass plated steel, brass, plated steel, and a polymer.

Figure 15:
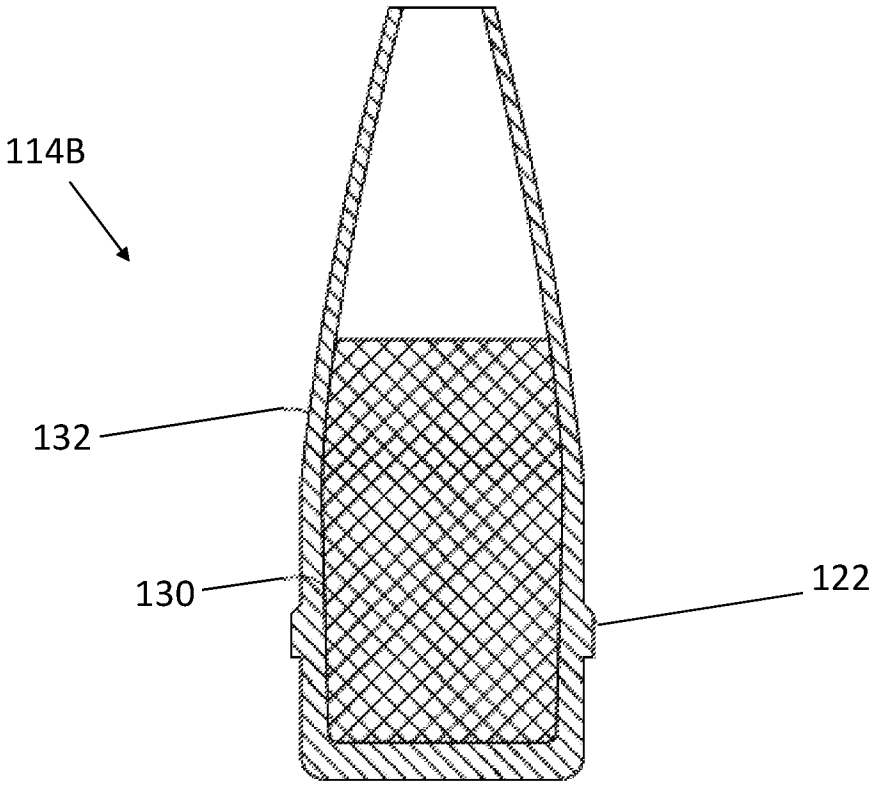
FIG. 15 is a cross-sectional view showing a projectile or bullet according to another embodiment.

Referring to FIG. 15, in embodiments, rimfire cartridges having a jacketed projectile or bullet 114B with a jacket 132 and a driving band 126 are shown. The cartridge of this embodiment includes a casing 102 and crimp 126 as shown in FIG. 10 and not shown in FIG. 14. The driving band diameter of this jacketed embodiment may be larger and longer than unjacketed embodiments depending on in-bore friction.

Various direction-indicating terms may be used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portly," and "starboardly," should not be interpreted to limit the scope of the invention recited in the attached claims.

The following United States patents are hereby incorporated by reference herein: U.S. Pat. Nos. 2,264,266, 2,286,064, 2,522,208, 2,765,558, 2,777,235, 3,087,270, 3,577,860, 4,127,954, 4,566,212, 4,580,364, 4,674,409, 4,672,760, 4,765,081, 4,776,122, 4,790,094, 4,888,899, 5,216,199, 5,502,913, 6,352,033, 7,011,028, 7,493,862, 8,407,922, 8,991,086, 5,301,449, 4,939,862, 4,739,572, 3,239,959, U.S. Ser. No. 10/234,221 and U.S. Ser. No. 10/240,879.

Components illustrated in the incorporated by reference references may be utilized with embodiments herein. Incorporation by reference is discussed, for example, in MPEP section 2163.07(B). The above references to U.S. patents in all sections of this application are herein incorporated by references in their entirety for all purposes.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A lead-free .22 caliber rimfire cartridge comprising:

a generally cylindrical casing having a rearward rimfire end and an opposing mouth end, wherein the rearward rimfire end has an annular rim connecting to a cylindrical casing portion extending to a casing forward edge of the mouth end;

a lead-free bullet disposed in the forward mouth end, the bullet comprising copper and a polymer binder, the bullet having a forward tapering portion with a central cavity, a first cylindrical portion with a first diameter and a cylindrical surface directly rearward of the tapering portion, a driving band directly rearward of the first cylindrical portion, the driving band having a second cylindrical surface with a second diameter greater than the first, a third cylindrical portion directly rearward of the cylindrical driving band, the third cylindrical portion having a third cylindrical surface with a diameter equal to or less than the first diameter, wherein the bullet is positioned with the third cylindrical surface mostly or entirely within the casing, the casing having a first circumferential crimp positioned at the third circumferential portion and rearward of the casing forward edge, the third circumferential surface having a first circumferential indentation at the first circumferential crimp, and wherein the casing forward edge has a second circumferential crimp and the third circumferential surface has a second circumferential indentation at the second circumferential crimp and forward of the first circumferential crimp.

2. The rimfire cartridge of claim 1, wherein the weight of the bullet is 19 to 23 grains.

3. The rimfire cartridge of claim 1, wherein the casing has a rolled crimp at the mouth.

4. The rimfire cartridge of claim 1, wherein the bullet requires a pull force for separation from the casing of from 68 to 80 lbs.

5. The rimfire cartridge of claim 1, wherein the bullet has a hollow point.

6. The rimfire cartridge of claim 1 wherein the driving band has a chamfer of 150 degrees (plus or minus 10 degrees), the angle measured between the chamfer surface and the first cylindrical surface.

7. The rimfire cartridge of claim 1 wherein the driving band having a cylindrical surface with a diameter of 0.2240 inches (plus or minus 0.0010 inches), and an axial length of 0.050 inches (plus or minus 0.010 inches), and a length of 0.410 inches (plus or minus 0.020 inches), the driving band position forwardly of the forward mouth end.

8. The rimfire cartridge of claim 7, wherein the bullet is positioned with the third cylindrical portion at least 95% lengthwise within the casing.

9. The rimfire cartridge of claim 1, when the second diameter of the driving band portion has a magnitude selected to provide a snug fit into a corresponding rifle bore when the cartridge is chambered in a match chambered rifle.

10. The rimfire cartridge of claim 1, wherein the rimfire cartridge is dimensioned and configured so that the first cylindrical portion contacts rifling inside a rifle barrel when the cartridge is chambered in a match chambered rifle.

11. The rimfire cartridge of claim 1, wherein the rimfire cartridge is dimensioned and configured so that the first cylindrical portion does not contact rifling inside a rifle barrel when the cartridge is chambered in a sporting chambered rifle.

12. The rimfire cartridge of claim 1, when the second diameter of the driving band portion has a magnitude selected so that the driving band portion engages rifling inside a rifle barrel after the cartridge is chambered in a sporting chambered rifle and the rifle is fired, igniting cartridge propellant.

13. The rimfire cartridge of claim 7, further comprising a primer material and a slow burning propellant disposed inside the casing, the slow burning propellant having a first weight and the primer having a second weight, and a ratio of the first weight to the second weight being less than 100.

14. The rimfire cartridge of claim 7, further comprising a primer material and a slow burning propellant disposed inside the casing, the slow burning propellant having a first volume and the primer having a second volume, and a ratio of the first volume to the second volume being less than 100.

15. The rimfire cartridge of claim 7, wherein the driving band is dimensioned and configured to engage rifling inside a rifle barrel after the cartridge is chambered in a rifle and the rifle is fired igniting cartridge propellant and the first cylindrical portion is dimensioned and configured to travel forwardly along the rifling inside rifle barrel after the cartridge is chambered in a rifle and the rifle is fired igniting cartridge propellant.

16. A .22 caliber rimfire cartridge comprising:

a generally cylindrical casing having a rearward rimfire end and an opposing mouth end, wherein the rearward rimfire end has an annular rim connecting to a cylindrical casing portion extending to a casing forward edge of the mouth end, the casing forward edge having a first circumferential crimp;

a bullet disposed in the forward mouth end, the bullet comprising copper and a polymer binder, the bullet having a forward tapering portion with a central cavity, a first cylindrical portion with a first diameter and a cylindrical surface directly rearward of the tapering portion, a driving band directly rearward of the first cylindrical portion, the driving band having a second cylindrical surface with a second diameter greater than the first, a third cylindrical portion directly rearward of the cylindrical driving band, the third cylindrical portion having a third cylindrical surface with a diameter equal to or less than the first diameter, wherein the bullet is positioned with the third cylindrical surface mostly or entirely within the casing, the casing having a second circumferential crimp positioned at the third cylindrical portion rearward of the casing forward edge, the third cylindrical surface having a circumferential indentation at the second circumferential crimp.

17. The rimfire cartridge of claim 16, wherein the bullet is composed of lead.

18. The rimfire cartridge of claim 17, wherein the bullet comprises a core and a jacket, wherein the jacket at least partially surround the core.

19. The rimfire cartridge of claim 18, wherein the core composition is selected from zinc, tin, lead, copper powder, and iron powder.

20. The rimfire cartridge of claim 18, wherein the jacket composition is selected from copper, brass plated steel, brass, plated steel, and a polymer.

* * * * *